United States Patent [19]

Thompson

[11] Patent Number: 4,850,079

[45] Date of Patent: Jul. 25, 1989

[54] FATIGUE-REDUCING HANDLE GRIP AND HANDLE ATTACHMENT FOR SAME

[76] Inventor: Franklin B. Thompson, 1237 S. Adams, Tacoma, Wash. 98405

[21] Appl. No.: 244,494

[22] Filed: Sep. 14, 1988

[51] Int. Cl.[4] ..... B25G 1/10

[52] U.S. Cl. ..... 16/111 R; 16/114 R; 16/DIG. 12; 16/DIG. 24; 30/232; 81/489; D8/80

[58] Field of Search ..... 16/111 R, 114 R, DIG. 12, 16/DIG. 24, DIG. 25, DIG. 40; 273/73 J, 75, 81 D, 81.2, 81.4, 165; 81/177.3, 177.5, 427.5, 489; D8/80, 310, 311, 313, 315; D7/141; 30/232, 298, 327

[56] References Cited

U.S. PATENT DOCUMENTS

| | | | |
|---|---|---|---|
| Des. 31,459 | 8/1899 | Rayment . | |
| Des. 156,370 | 12/1949 | Randall | D44/29 |
| 1,273,642 | 7/1918 | Margetts . | |
| 1,315,503 | 9/1919 | Hughes . | |
| 1,648,354 | 11/1927 | Lied | 273/81.4 X |
| 2,576,751 | 11/1951 | Dortmund | 81/489 |
| 2,682,705 | 7/1954 | Johnson | 30/324 |
| 2,863,459 | 12/1958 | Casper | 81/427.5 X |
| 2,942,342 | 6/1960 | Warren et al. | 30/327 |
| 2,981,133 | 4/1961 | Campman et al. | 81/427.5 X |
| 3,203,697 | 8/1965 | Berzatzy | 273/81 D X |
| 3,224,093 | 12/1965 | Huck | 30/324 |
| 3,425,468 | 2/1969 | Soucy | 81/489 |
| 3,880,443 | 4/1975 | Tobin | 280/11.37 |
| 3,992,021 | 11/1976 | Tobin | 380/11.37 |
| 4,351,526 | 9/1982 | Schwartz | 272/122 |
| 4,376,536 | 3/1983 | Martin | 273/81.4 |

FOREIGN PATENT DOCUMENTS 1112170 3/1956 France .

*Primary Examiner*—Fred A. Silverberg
*Attorney, Agent, or Firm*—Glenn D. Bellamy

[57] ABSTRACT

Disclosed is a grip-enhancing device for a shaft handle which includes a grip portion generally coaxial with the shaft and sized to be grasped generally around its longitudinal axis by the palm and fingers of a user's hand. The grip-enhancing improvement comprises a rigid first portion extending substantially radially outwardly from the grip portion and presenting a surface positioned to bear against an edge of the user's hand. The surface has a cross-section which is spaced radially from and extends obliquely with respect to the longitudinal axis of the grip portion. A rigid second portion extends from the first portion in a direction oblique to the longitudinal axis of the grip portion and toward the user's wrist. The grip portion, the first portion and the second portion define a gap in which the user's hand is partially captured, thereby preventing axial and lateral slipping of the hand from the handle and reducing fatigue to the user.

7 Claims, 2 Drawing Sheets

Fig. 5
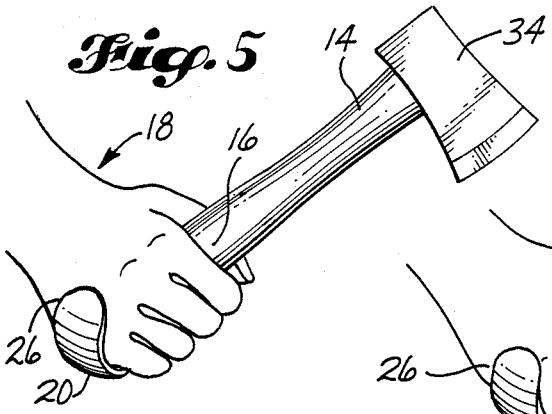
Fig. 6
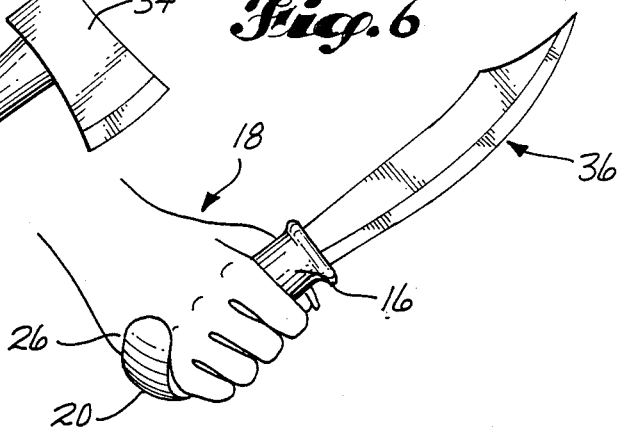
Fig. 7
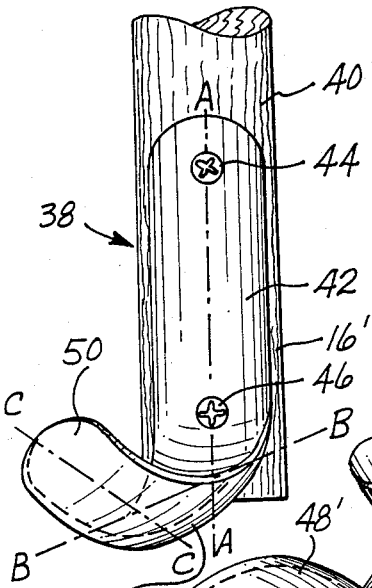
Fig. 8
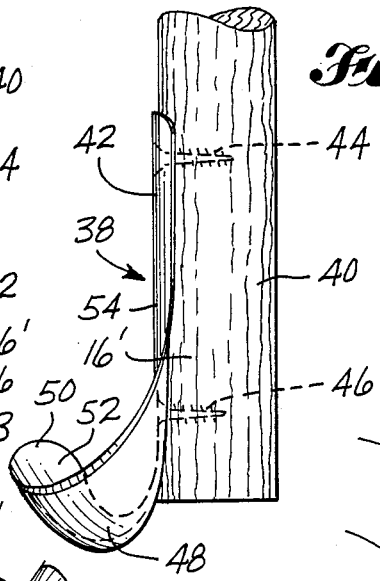
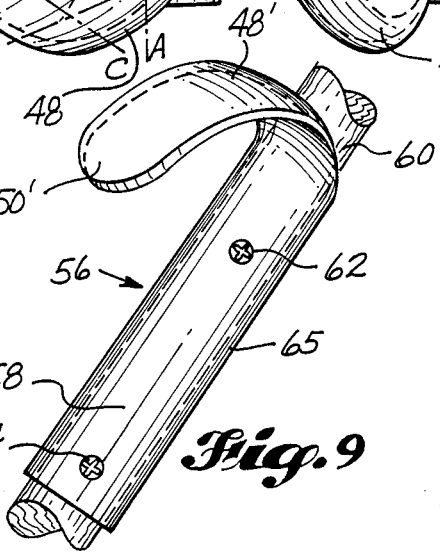
Fig. 9
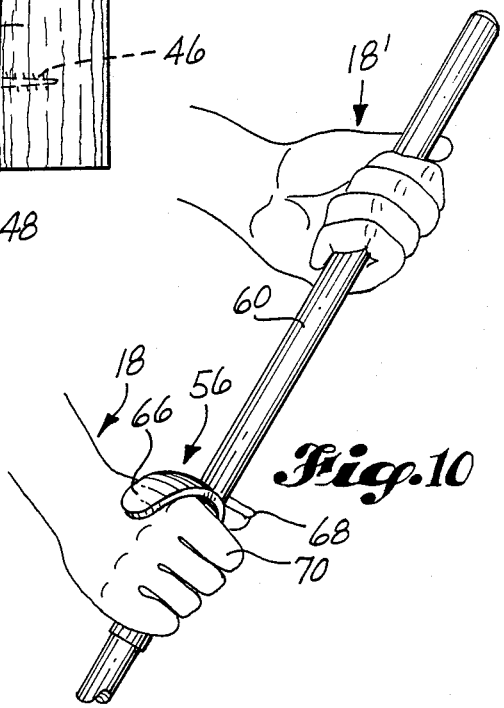
Fig. 10

FATIGUE-REDUCING HANDLE GRIP AND HANDLE ATTACHMENT FOR SAME

DESCRIPTION

1. Technical Field

This invention relates to a handle for a tool or other article which provides a grip-enhancing flange shaped to curve around an edge of the user's hand as the handle is being grasped.

2. Background Art

During normal use of a short-handled tool, such as a hammer, a hatchet or a knife, or a long-handled tool, such as a broom, a rake, a hoe or a shovel, the user's hand(s) must maintain a grip on the handle both to prevent the handle from sliding out of the user's hand(s) and to control the movement of the tool. It is well-known that extended use of such a tool may cause the user's hand to cramp or fatigue, weakening the grip of the user's hand on the handle.

Such a diminished grip on the tool's handle may cause the user's grip to fail, allowing the tool to slip from the user's hand. This situation can present a serious danger to both the user and bystanders if the tool is in rapid motion. Alternatively, if the user concentrates on maintaining a hold on the handle, the user's control of the tool may suffer, resulting in inaccurate direction or inefficient movement and use of the tool.

U.S. Pat. No. 1,315,503, issued Sept. 9, 1919, to Rupert Hughes, discloses a retractable trench knife secured to the back of the user's hand by a strap which extends across the entire width of the user's palm. The handle of the trench knife includes lateral portions which bear against both edges of the user's hand so that, in conjunction with the strap, the knife is effectively bound to the user's hand.

U.S. Pat. No. 3,880,443, issued Apr. 29, 1975, and U.S. Pat. No. 3,992,021, issued Nov. 16, 1976, both to James E. Tobin, disclose strapless grips for ski poles. Each of these patents disclose resilient finger portions which protrude from the grip of the handle and extend toward each other across slightly less than the entire back of the user's hand.

Benassy, French Pat. No. 1,112,170, discloses the benefit of a contoured hand grip in reducing muscle fatigue and maximizing muscle output.

DISCLOSURE OF THE INVENTION

The present invention provides a handle with grip-enhancing features to be integrally formed with, or attached to, a handle which has a grip portion sized to be grasped generally axially by the palm and fingers of a user's hand. A rigid laterally extending first portion projects substantially radially from the grip portion of the handle adjacent an edge of the user's hand to provide an inner surface which has a cross-section which is spaced radially from and extends obliquely with respect to the longitudinal axis of the handle and which presents a surface against which an edge of the user's hand may bear. A rigid second portion extends from the first portion in a direction oblique to the longitudinal axis of the grip portion and rearwardly toward the user's wrist. The second portion is shaped to provide support against the back of the user's hand between the user's wrist and knuckles. The first and second portions together provide support to prevent longitudinal and lateral slipping of the handle from the grasp of the user's hand and to reduce muscle fatigue.

BRIEF DESCRIPTION OF THE DRAWINGS

In the drawings, like element designations refer to like parts throughout, and:

FIG. 5 is a pictorial view of a hand gripping the handle of a hatchet modified according to a preferred embodiment of the invention;

FIG. 6 is a pictorial view of a hand gripping the handle of a hunting knife modified according to a preferred embodiment of the invention;

FIG. 7 is a side view of the second preferred embodiment of the invention attached to a portion of a handle shaft;

FIG. 8 is a front view of the embodiment shown in FIG. 7;

FIG. 9 is a side view of an alternative embodiment of the invention shown mounted to a portion of a handle; and FIG. 10 is a pictorial view of the hands of a user gripping a handle which includes the embodiment of the invention shown in FIG. 9.

BEST MODE FOR CARRYING OUT THE INVENTION

Figure 1:
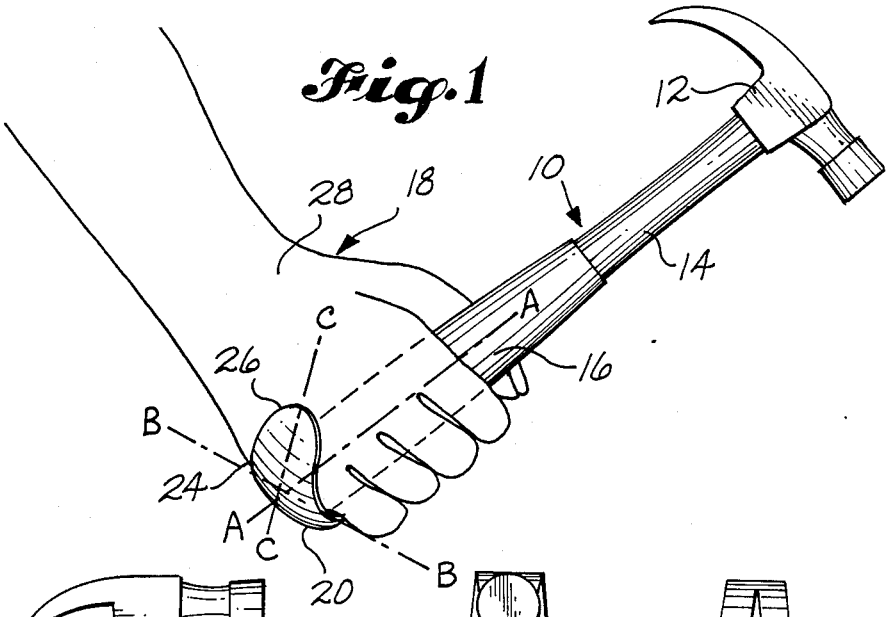
FIG. 1 is a side view of a hand gripping the handle of a hammer modified according to the first preferred embodiment of the invention.

Referring now to the several figures of the drawing, and first to FIG. 1, therein is shown a hammer 10 modified in accordance with the present invention. The hammer 10 includes a head portion 12 and a handle shaft 14 having a grip portion 16. The grip portion 16 is longitudinally coaxial with the handle shaft 14. The grip portion 16 and the handle shaft 14 may be integral extensions of one another, as is normal when the handle 14, 16 is made of wood, or may be separate portions assembled together, such as when the handle shaft 14 is made of fiberglass or metal and the grip portion 16 is made of a cushioning material.

Shown at 18 is a user's right hand gripping the grip portion 16 in a normal manner. In normal use, a short-handled tool, such as a hammer 10, is swung or otherwise moved into contact with a workpiece (not shown). During such use, the user grips the handle 14, 16 for the combined purpose of directing the movement of the tool and retention of the handle 14, 16 against axial slippage from the user's hand 18. Normally, a grip is maintained by squeezing the grip portion 16 against the palm with the fingers of the hand 18 which are wrapped around the grip portion 16.

The present invention allows the user to concentrate gripping efforts on directing the tool, rather than on retaining the tool, by providing a rigid lateral portion 20 which extends radially outwardly from the grip portion 16 of the handle shaft 14. The lateral extension 20 presents a surface 22 against which the "cutting edge" 24 of the user's hand 18 may bear. The cutting edge of the hand is substantially along the fifth metacarpal and is adjacent to the fifth, or "little", finger. Also, extending from the rigid lateral portion 20 is a second rigid portion 26 which is shaped to a closely contacting and bearing against the back 28 of the user's hand 18 between the wrist and knuckles. This portion 26 provides lateral support to the user's hand 18.

Figure 2:
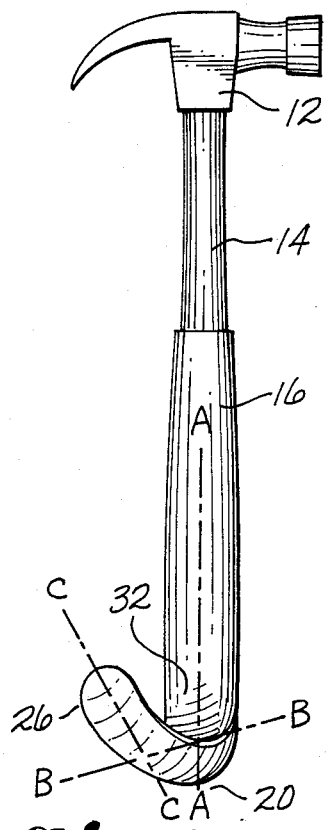
FIG. 2 is a side view of a hammer modified according to the first preferred embodiment of a grip-enhancing handle.
Figure 3:
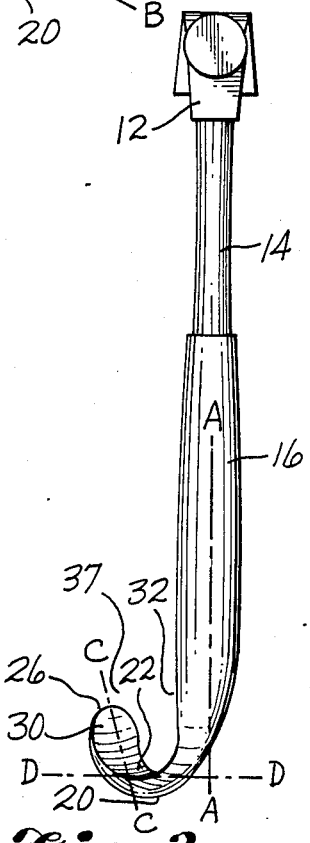
FIG. 3 is a front view of the hammer shown in FIG. 2.

According to an aspect of the invention, the surface 22 of the laterally extending portion 20 is angled with respect to the axis of the handle 14, 16. Referring to FIGS. 1 and 2, dashed line A—A indicates generally the longitudinal axis of the handle 14, 16. Dashed line B-B generally indicates the transverse direction of the inner surface 22 consistent with a cross-section of the laterally extending portion 20. The angle between the handle axis A—A and the inner surface 22 conforms generally to the forward inclination naturally given to such a handle 14, 16 by the hand 18 when gripped for working movement. This may be from about 15 to 25 degrees. Referring also to FIG. 3, therein is shown the lateral, generally radial direction of extension of the rigid lateral portion 20 relative to the handle 14, 16. Dashed line D-D represents the radial direction of this extension relative to the longitudinal axis A—A of the handle 14, 16.

Dashed line C—C generally indicates the direction of extension of the rigid second portion 26. This portion 26 presents an inner surface 30 which is generally parallel to a side surface 32 of the gripping portion 16 which is normally held against the palm of the user's hand 18. However, the second rigid portion 26 extends in one direction, shown by dashed line C—C, which is oblique to the longitudinal axis (A—A) of the handle 14, 16 thereby being offset rearwardly toward the user's wrist. In this manner, the second rigid portion 26 bears against the back 28 of the user's hand 18 between the wrist and knuckles, rather than against the user's knuckles or fingers. The second rigid portion 18 thereby provides rigid support against lateral displacement of the handle 14, 16 from the user's hand 18.

A gap 37 is defined by and between the grip portion 16, the lateral extension 20, and the second portion 26. This gap 37 is shaped to receive the user's hand, partially capturing it therein. If the gap 37 is sized to closely capture the user's hand 18, and the tool is relatively lightweight, as in the case of a knife 36, the tool will be retained on the user's hand even when the user's grip is opened. This may allow the fingers to be free for fine manipulation without laying the tool down between uses.

As shown in FIGS. 5 and 6, a handle 14, 16 having the above-described features may be used with other tools having elongated handle grips such as a hatchet 34 or a knife 36. A handle of this form is also readily adaptable to any other tool of this general configuration which is gripped by the user's hand 18 and moved to provide striking, chopping, cutting, lifting or prying force on an object.

Figure 4:
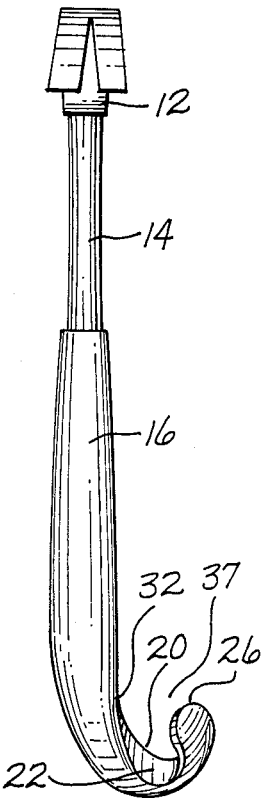
FIG. 4 is a rear view of the hammer shown in FIGS. 2 and 3.

The grip-enhancing handle of this invention may be integrally formed as an extension from the grip portion 16 of a tool, as shown in FIGS. 2–4, or may be separately formed and added to existing handles as shown in FIGS. 7 and 8.

Referring to FIGS. 7 and 8, this embodiment 38 employs structural features identical in function to those in the above-described embodiment. This alternate embodiment 38 is in the form of a retro-fitted grip-enhancing attachment for existing handles 40. The attachment 38 comprises a portion 42 which is shaped to generally conform to the gripping portion 16' of a tool handle 40. The attachment 38 may be secured to the handle 40 by means of screws 44, 46 or any other means which relatively rigidly secures the attachment 38 to the handle 40. The attachment portion 42 is adjacent the palm of the user's hand 18 when a tool having the attachment 38 is gripped for use.

A laterally extending rigid portion 48 presents a surface which bears against the cutting edge 24 of the user's hand 18 and is angled with respect to the longitudinal axis (A—A) of the handle 40. A second rigid portion 50 extends from the lateral extension 48 at an angle with respect to the longitudinal axis (A—A) of the handle 40 and presents an inner surface 52 which is generally parallel to the outer surface 54 of the attachment portion 42.

By the addition of this attachment 38, existing tools having handles which are gripped for use may be modified to provide the above-described grip-enhancing characteristics and features.

According to another aspect of the invention, the grip-enhancing attachment 38, 56 may be used to provide grip-enhancing characteristics of a long-handled tool, such as a broom, mop, rake, hoe, shovel, etc. Referring to FIGS. 9 and 10, this embodiment 56 may have an attachment portion 58 which is secured to a handle 60 by screws 62, 64 or other suitable securing means. The attachment portion 58 may be shaped to lie closely adjacent to a portion of the circumference of the handle 60, or may be constructed to have a generally tubular body 65 which completely surrounds the circumference of a portion of the handle 60. Such an embodiment features the same above-described support characteristics by providing a first laterally extending rigid portion 48' and a second rigid support portion 50'. Such an arrangement 56 may have portions 48'and 50' shaped to generally conform with the upper edge 66 of a user's right hand 18, as illustrated, between the thumb 68 and forefinger 70. Such a configuration is useful when the long-handled tool is moved for use in a sweeping or lifting motion. Such a use is shown in FIG. 10 wherein the user grasps the handle 60 with both the right and left hands 18, 18'. In this embodiment, the second portion 50'extends obliquely to the longitudinal axis of the handle 60, toward the user's wrist.

The attachment 38, 56 may be modified in any necessary form to conform with the general contour, size or shape or the handle 40, 60 or hand 18, and may be produced in a mirror-image form of the illustrated embodiments for left-handed use. It is also to be understood that other modifications or alterations may be made in the disclosed grip-enhancing handle or handle attachment without departing from the spirit and scope of the invention as described and claimed. Therefore, the scope of my patent protection is not to be limited by the described and illustrated embodiments, but rather by the following claims in accordance with accepted doctrines of patent interpretation.

What is claimed is:

1. A grip-enhancing handle, comprising:

a shaft handle having a grip portion sized to be grasped generally around a longitudinal axis by the palm and fingers of a user's hand;

a rigid first portion extending substantially radially outwardly from said grip portion and presenting an inner surface positioned to bear against an edge of the user's hand, said surface being substantially congruous with a first plane which obliquely intersects said longitudinal axis and congruently intersects a line radially extending from said longitudinal axis; and a rigid second portion extending from said first portion substantially in a direction oblique to the longitudinal axis of the grip portion and rearwardly toward the user's wrist, said second portion presenting an inner surface substantially congruous with a second plane which is substantially parallel to said longitudinal axis and substantially perpendicular to said radial line and said first plane, said second portion being shaped to bear against the back of the user's hand between the user's wrist and knuckles, wherein a gap is defined between said grip portion and said second portion such that the user's hand is partially captured within said gap, thereby providing support and preventing undesired axial and lateral movement of the handle from the hand and providing a fatigue-reducing grip aid.

2. The grip-enhancing handle of claim 1, wherein a smoothly curving junction is provided between said grip portion, said first portion, and said second portion.

3. For use with an elongated handle having a grip portion sized to be grasped generally axially by the palm and fingers of a user's hand, a grip-enhancing attachment, comprising:

an attachment portion generally conforming to the shape of said grip portion and having means for securing said attachment portion to said handle;

a rigid first portion extending substantially radially outwardly relative to said grip portion and presenting an inner surface positioned to bear against an edge of the user's hand, said surface being substantially congruous with a first plane which obliquely intersects a longitudinal axis of said grip portion and congruently intersects a line radially extending from said longitudinal axis; and a rigid second portion extending from said first portion substantially in a direction oblique to the longitudinal axis of the grip portion and rearwardly toward the user's wrist, said second portion presenting an inner surface substantially congruous with a second plane which is substantially parallel to said longitudinal axis and substantially perpendicular to said radial line and said first plane said second portion being shaped to bear against the back of the user's hand between the user's wrist and knuckles, wherein a gap is defined between said grip portion and said second portion such that the user's hand is partially captured within said gap, thereby providing support and preventing undesired axial and lateral movement of the handle from the hand and further providing a fatigue-reducing grip aid.

4. The attachment of claim 3, wherein said securing means includes a screw fastener.

5. The attachment of claim 3, wherein said securing means includes said attachment portion having an axial opening sized to receive said handle grip portion.

6. The attachment of claim 5, wherein said securing means further includes a screw fastener extending through said attachment portion and into said handle.

7. The attachment of claim 3, wherein a smoothly curving junction is provided between said grip portion, said first portion, and said second portion.

* * * * *